US005263707A

United States Patent [19]

Kuzumi

[11] Patent Number: 5,263,707

[45] Date of Patent: Nov. 23, 1993

[54] COMBINED STACKER AND SORTER

[75] Inventor: Tadayuki Kuzumi, Tokyo, Japan

[73] Assignees: Gradco (Japan) Ltd.; Kyocera Corporation, Tokyo, Japan

[21] Appl. No.: 847,906

[22] Filed: Mar. 9, 1992

[51] Int. Cl.[5] ..... B65H 39/10

[52] U.S. Cl. ..... 271/293; 271/298; 271/273

[58] Field of Search ..... 271/293, 296, 298, 288, 271/292, 303, 273

[56] References Cited

U.S. PATENT DOCUMENTS

| | | | |
|---|---|---|---|
| 3,973,769 | 8/1976 | Cross et al. | 271/293 X |
| 3,990,695 | 11/1976 | Cross et al. | 271/293 X |
| 4,478,406 | 10/1984 | DuBois | 271/293 |
| 4,580,775 | 4/1986 | Maruyama | 271/294 X |
| 4,691,914 | 9/1987 | Lawrence | 271/297 |
| 4,842,264 | 6/1989 | Kosaka et al. | 271/293 |
| 4,843,434 | 6/1989 | Lawrence et al. | 271/293 X |

*Primary Examiner*—David H. Bollinger

*Attorney, Agent, or Firm*—Newton H. Lee, Jr.

[57] ABSTRACT

Apparatus is provided for receiving sheets of paper from a host printer and selectively transporting the sheets to a stacker tray or to a selective tray sheet sorting machine of the bin opening type. The apparatus has a sheet transport system for receiving sheets and gating the sheets to an infeed for the stacker tray or transporting the sheets to the infeed of the sheet sorting machine. The sheet transport system is in part incorporated in a cabinet door which completes the sheet transport when closed and when opened affords access to the infeeds for the stacker tray and the sorter. The sorter has nested trays to occupy a small vertical space and a tray opener which moves to locations between trays to pivot the trays open adjacent to the sheet infeed to provide a large space between trays for entry of the sheets. The sheet infeeds to the stacker tray and sorter trays can be opened when the door is open to provide access, and a blocking device prevents clsoure of the door if one of the infeeds is open.

10 Claims, 7 Drawing Sheets

COMBINED STACKER AND SORTER

BACKGROUND OF THE INVENTION

Printers, such as laser printers, have evolved for general office use which are capable of producing printed sheets in sequence which are fed from the printer to a receiver or stacker. In general, the sheets are supplied in sequence to form sets of sheets constituting a multiple page document, or, in some cases, to provide successively different documents of one or more sheets which when received in a stacker or receiver tray require manual separation.

There exist receiving devices which can receive the sets of sheets or documents of one or more sheets in sorting trays which function as a pigeon hole or mailbox for the documents, in that the sheets are transported to and deposited in selected trays. Such sorting machines are disclosed for example in U.S. Pat. No. 4,580,775 of Ikegami Tsushinki Co., Ltd., U.S. Pat. Nos. 4,478,406, 4,691,914 and 4,843,434 of Gradco (Japan) Ltd. Other prior art sorting machines exist of the fixed bin or moving bin types which can provide for sequential receipt of sheets in the trays or, if required, random access of the sheets to the trays. In these machines, sequential feeding of sheets to the trays is employed for collating sets of sheets in the trays or, depending upon the control system employed, the trays may be supplied sequentially with a number of sheets constituting a document for job separation. In other cases the machines may be operated for random access of the sheets, so that a particular document of any number of sheets may be directed to a selected tray, whereby any selected job will be deposited only in a selected tray as in mailboxing or pigeon holing.

Another moving bin sorter is known, for example, as illustrated in U.S. Pat. No. 4,930,761 of Canon Kobushiki Kaisha in which the paper path is divided so that sheets to be sorted are directed to a first set of trays which are shifted relative to one sheet entry location, and sheets which are to be collected but not collated by tray movement are delivered to a second set of movable trays which move with the first set.

SUMMARY OF THE INVENTION

The present invention relates to providing apparatus for both stacking and sorting, or mailboxing, documents of one or more sheets, depending upon the kind of work being performed by the printer.

More particularly, the apparatus of this invention provides a stacker and a sorter of the general type referred to above, wherein the stacker and sorter are arranged in a frame or enclosure which forms a base on which the printer may be placed in the office. The stacker and sorter are placed in the frame or housing, one above the other, and sheets are supplied from the printer to a sheet transport which can be operated to transport sheets or documents either to the stacker or to the sorter, as may be required by the job being performed by the printer and the need to separate documents of the same or different kinds and/or place documents in only certain selected trays.

In accomplishing the foregoing, the invention provides a unique sheet transporting system. This sheet transporting system is constructed to receive sheets supplied from the printer and transport the sheets to an infeed for the stacker, or at the option of the user to by-pass the stacker infeed and transport the sheets to an infeed for the sorter.

More specifically the sheet transport, in accordance with the invention, is incorporated in a frame structure for the stacker and sorter and in a door of the frame in such a way that the door can be closed to complete the transport system and can be opened enabling manual access to the transport system, including, in this case, the infeeds to the stacker and the sorter which receive sheets from the transport. This transport system, therefore, is simple, but still permits clearing of any paper jams, which may occur in the stacker or in the sorter. In its more specific form, the invention also involves a stacker infeed which opens to further facilitate clearing of jams. In its preferred form, the sorter has an infeed which may also be opened to enable clearing of any paper jam. A device is preferrably included to indicate that one of the infeeds is open and prevents re-closing of the door.

At the end of the apparatus opposite to the door, the frame is open at the opposite end from the transport and stacker and sorter infeeds, to allow manual access and removal of documents from the stacker and sorter trays.

The invention possesses other features of construction and advantages which will become apparent from; the following detailed description of the illustrative embodiment shown in the accompanying drawings.

DESCRIPTION OF PREFERRED EMBODIMENT

Figure 1:
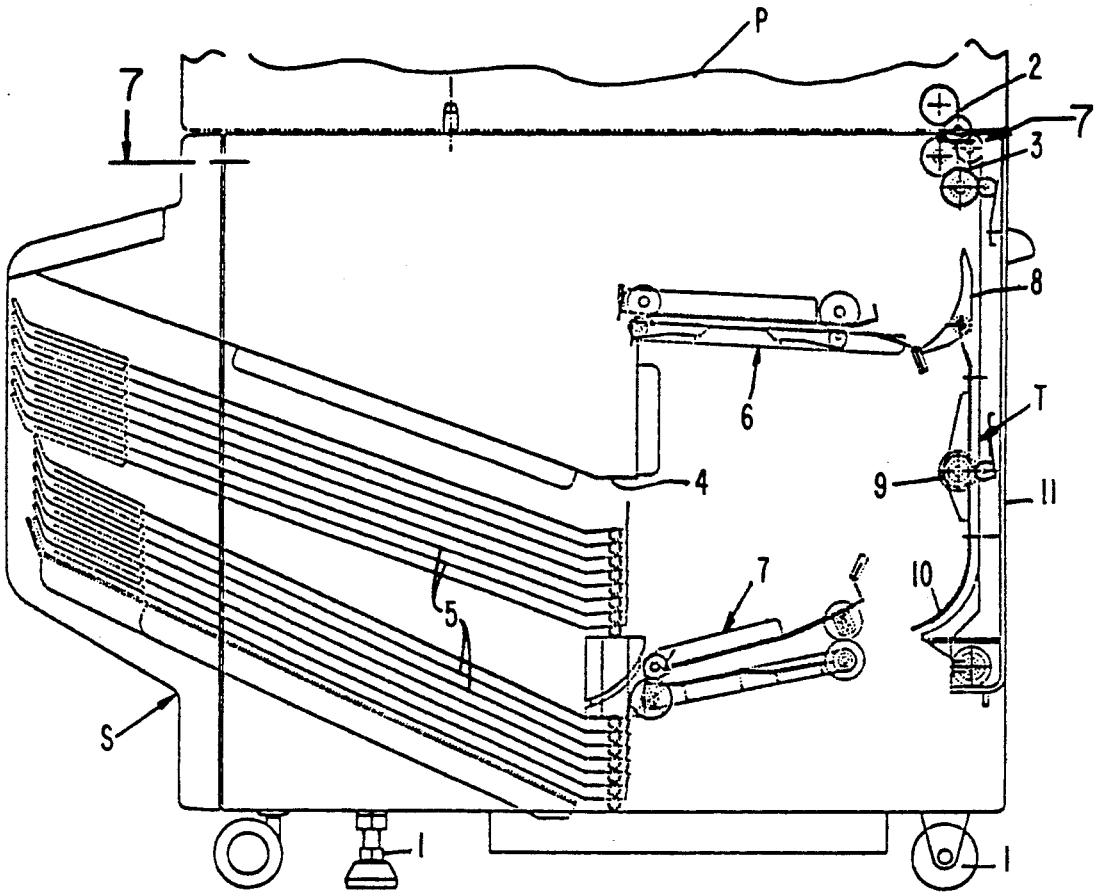
FIG. 1 is a side elevation of the apparatus, showing a fragmentary portion of a printer.
Figure 2:
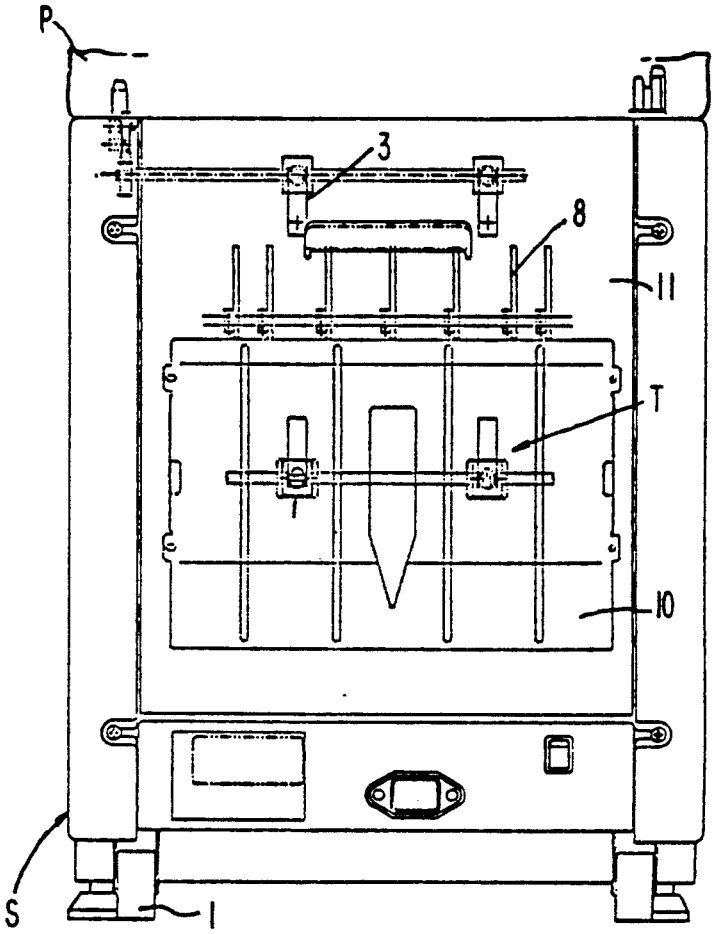
FIG. 2 is a right end elevation thereof.
Figure 3:
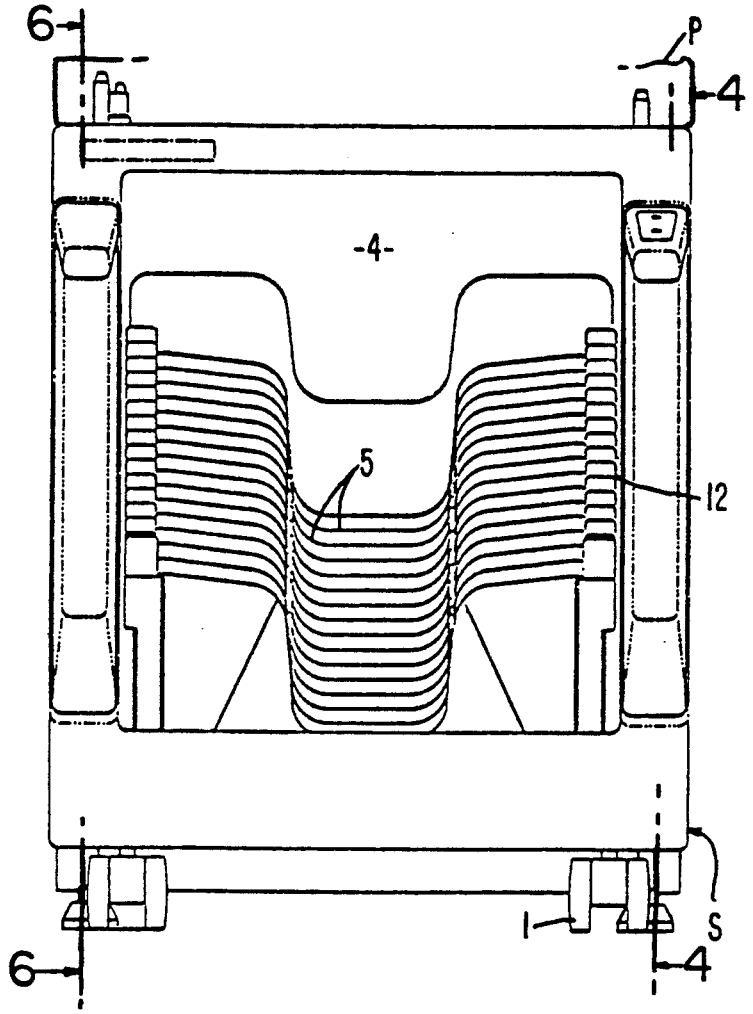
FIG. 3 is a left end elevation thereof.

As seen in the drawings, referring first to FIGS. 1-3, a printer or other sheet providing machine P is shown resting on top of a sheet sorter/stacker S made in accordance with the invention. The sorter/stacker provides a base for the printer and has suitable casters 1 to rest on a base support.

The printer is adapted to produce printed sheets which are fed by output rolls 2 to input rolls 3 of the sorter/stacker, from which the sheets are to be distributed either to a stacking tray 4 or to sorting trays 5 by a sheet transport systems means T which includes a stacker infeed means 6 and a sorter infeed means 7, depending upon the position of a gate 8. Gate 8 is adapted to be closed to deflect sheets into the stacker infeed 6 or to be opened so that sheets move past it to intermediate feed rolls 9 which feed sheets to an arched guide 10 and then to the infeed 7 for the sorter trays 5. A door 11 is provided on one end of the sorter/stacker housing and an opening 12 is provided at the other end of the sorter/stacker housing through which sheets in the stacker tray 4 or the sorter trays 5 may be manualy removed.

Therefore, the sorter/stacker assembly, as a whole provides for a simple assembly selectively operable to stack the output of sheets from the printer in the stacker tray, 4 or to collect sorted sets of documents or sheets supplied to the sorter trays, the assembly being such that a) the transport means T, as will be later described in greater detail, is pivotally incorporated in the door 11 to provide ease of access to the transport and its stacker and sorter infeeds 6 and 7, and b) the sheets collected in the receiving trays may be easily removed, both advantageously in a construction which is compact and wherein there is a unique correlation in the functions of stacking and sorting the output from the printer.

Figure 4:
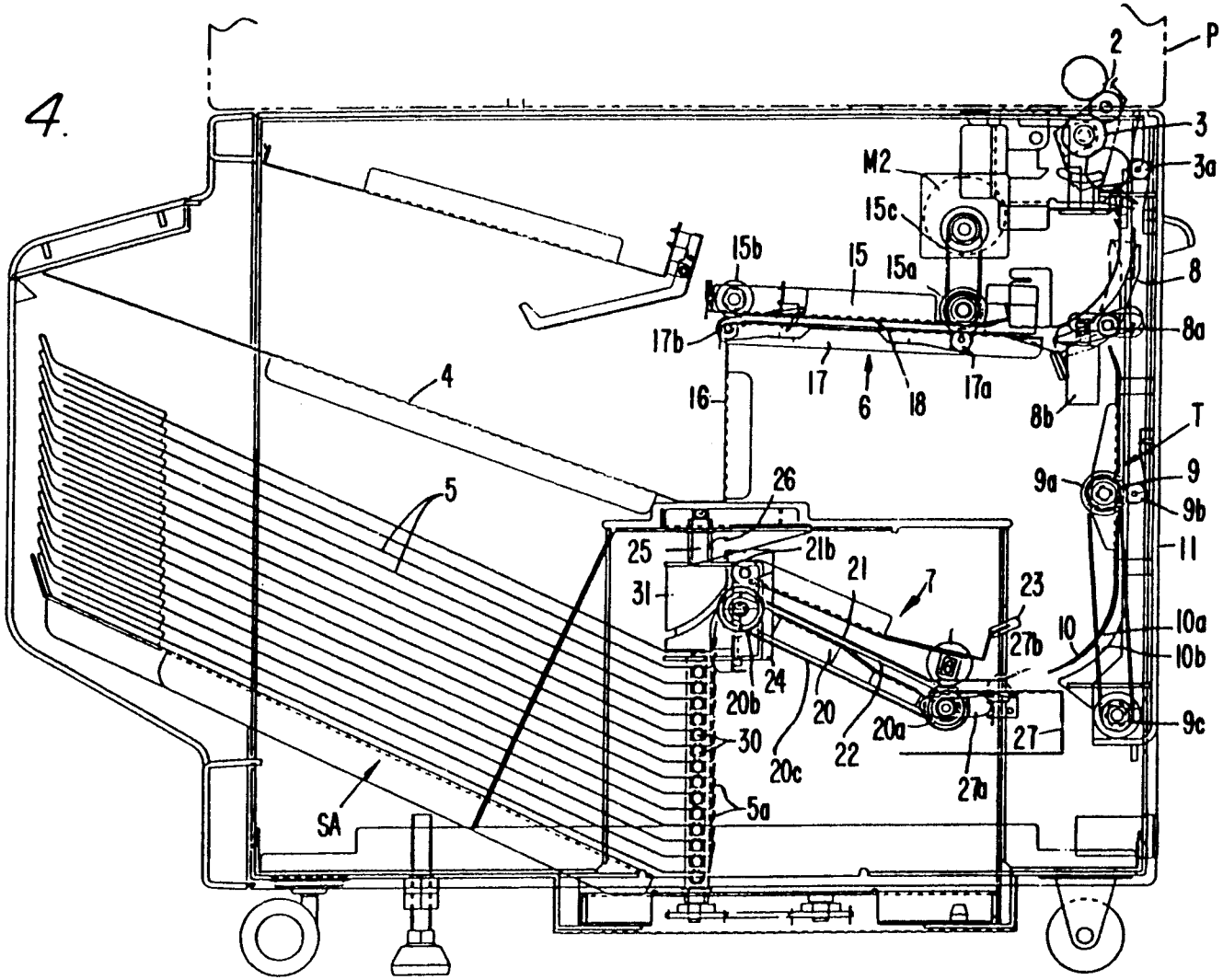
FIG. 4 is a vertical section on the line 4—4 of FIG. 3, showing the apparatus in condition for stacking sheets.
Figure 5:
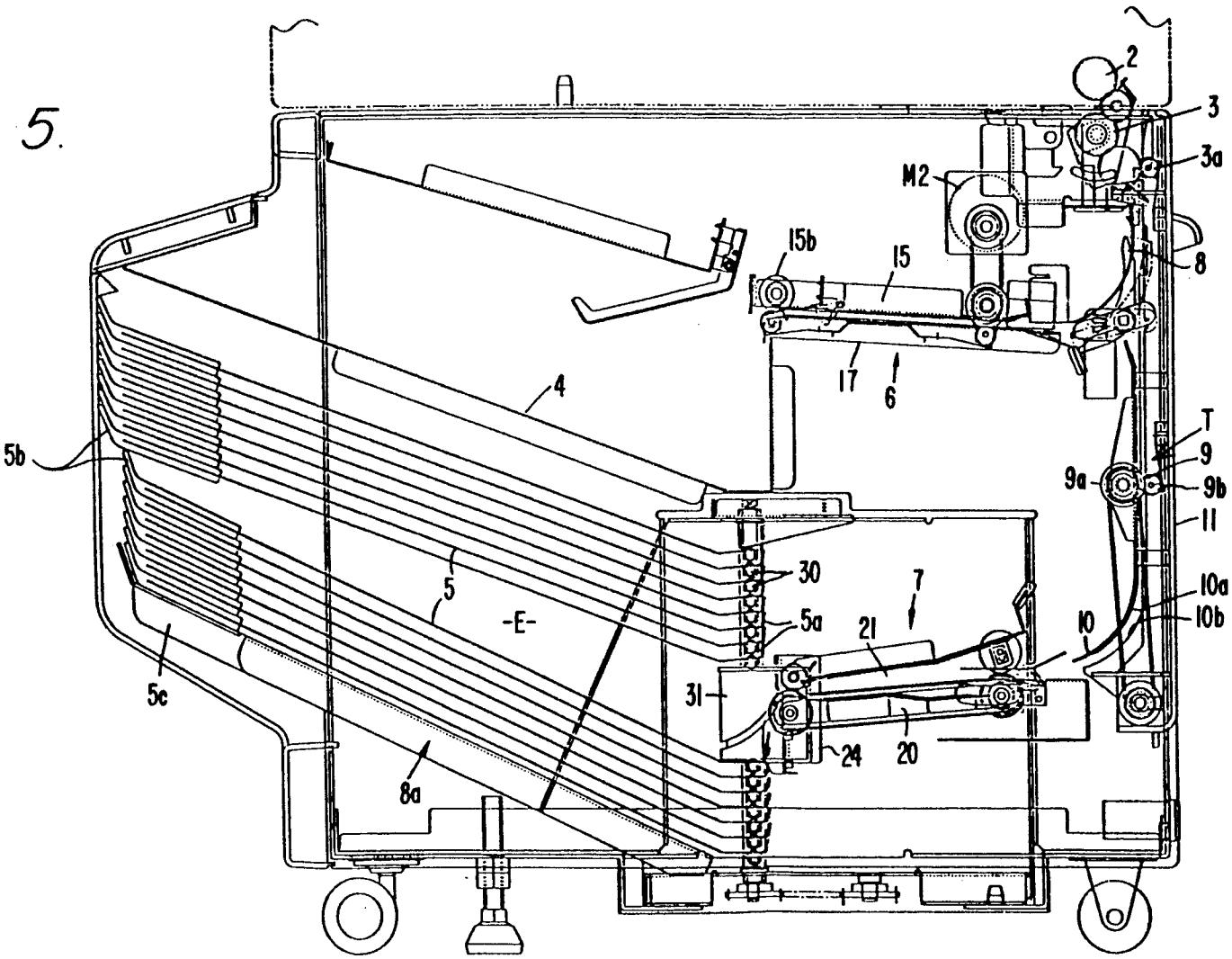
FIG. 5 is a view corresponding to FIG. 4, but showing the apparatus in sorting condition.

Referring to FIGS. 4 and 5 it will be seen that when the door 11 is closed, the sheet transport T is completed for transporting sheets from the infeed rolls 3 of the sorter/stacker. The door 11, for this purpose, has an infeed roll 3a forming part of infeed rolls 3. At an appropriate location below gate 8 and door 11, the transport rolls 9 include a driven roll 9a and a nip roll 9b adapted to transport sheets to a feed space between an arched guide plate 10a and an opposing arched portion 10b of the door forming the sheet guide 10 for directing sheets to the sorter infeed 7. The drive for rolls 3a and 9a will be later described.

Stacker infeed means 6 comprises a fixed plate 15 extended generally horizontally from adjacent to gate 8 to the top of the lower end 16 of the upwardly inclined stacker tray 4. A lower guide plate 17 defines with plate 15 sheet guide path 18. A chord of a pair of drive rolls 15a and 15b extends through plate 15, the rolls being rotatably supported on top of the plate. Lower plate 17 has a pair of nip rolls 17a and 18b rotatably supported to oppose the driven rolls for transporting sheets through the guide path 18. Lower plate 17 is pivoted on the axis of nip rolls 17b and normally held in operative position by a latch which is releasable to allow the lower plate to swing downwardly about its pivot axis to the position of FIG. 6, to be later described. The drive for driven rolls 15a and 15b will also be later described.

Sorter infeed means 7 includes a lower guide plate 20 provided with a pair of horizontally spaced driven feed rolls 20a and 20b. An upper guide plate 21 has spaced nip rolls 21a and 21b opposing the driven rolls 20a and 20b to transport the sheets in a guide path 22 between the plates. Plate 21 is adapted to pivot about the axis of nip roll 21b and to be lifted by a lift tab 23. At their inner ends, the plates 20 and 21 are mounted for pivotal movement on a cage 24 vertically shiftably supported on rods 25 and engaged in slots 26, so that the inner end of the infeed means 7 is vertically shiftable, as later described. At their outer ends, plates 20 and 21 are mounted for horizontal sliding movement in and on brackets 27 having an arched groove 27a in which the end of plate 20 slides and an inclined surface 27b on which plate 21 slides to enable the plate 21 to be lifted by lifter 23. This longitudinal sliding of the sorter infeed plates permits vertical shifting of the cage 24, during sorting of sheets, as will be later described.

Figure 6:
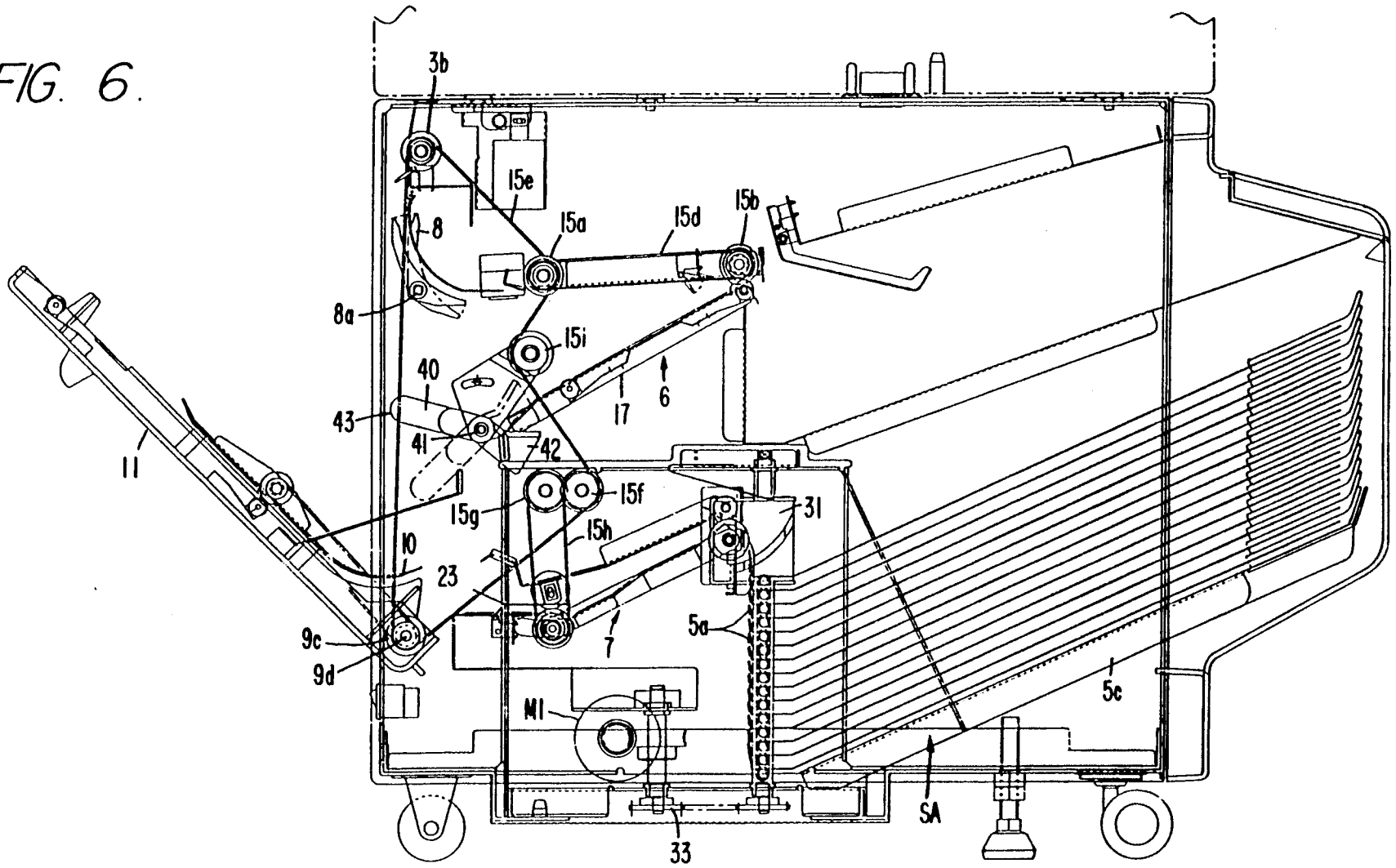
FIG. 6 is a fragmentary vertical section on the line 6—6 of FIG. 3, showing the door open.
Figure 7:
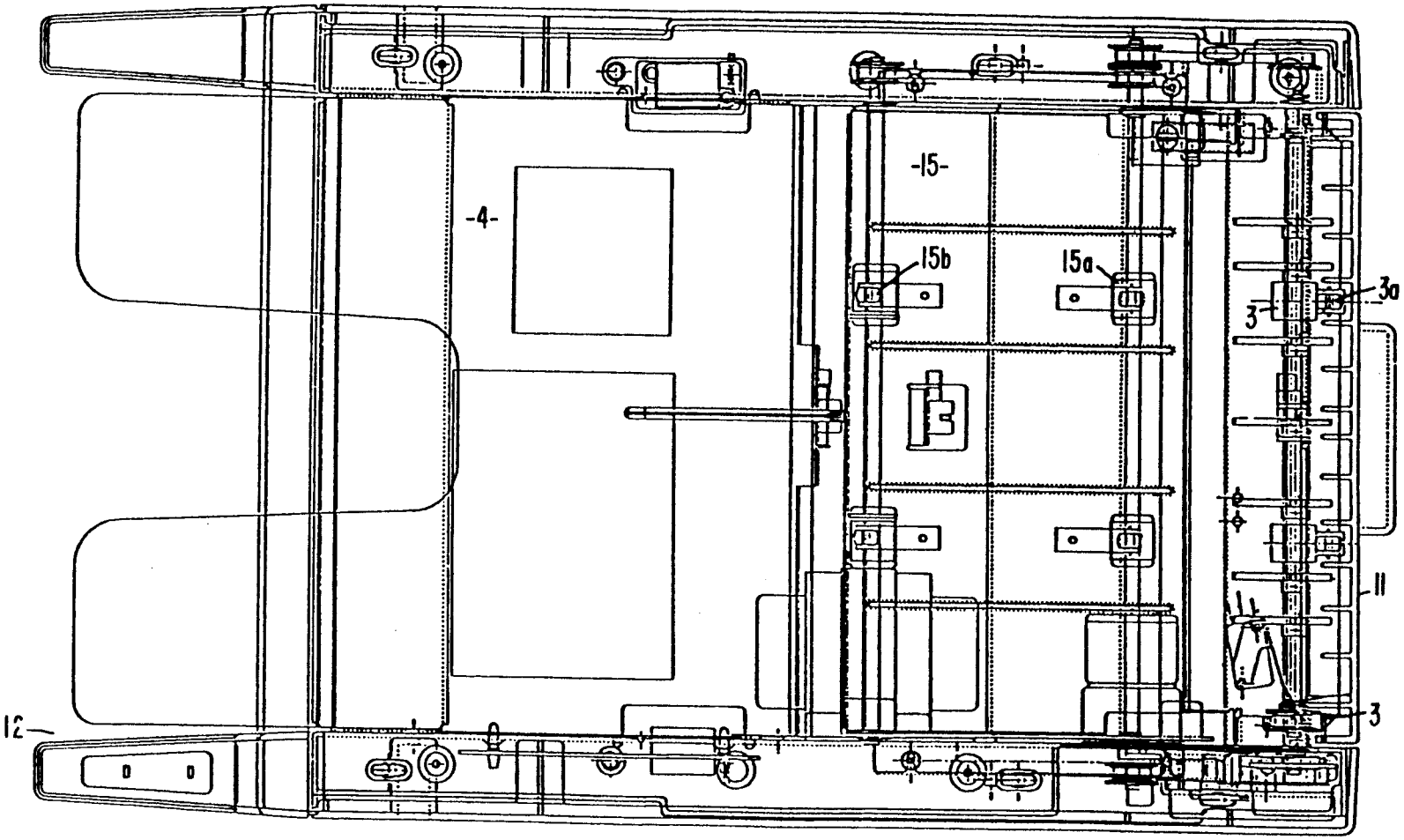
FIG. 7 is a horizontal section on the line 7—7 of FIG. 1.

All of the driven feed rolls have a common drive. Referring to FIG. 4, it will be seen that a drive motor M2 drives a chain or belt 15c which has a drive connection with the driven roll 15a of the stacker input means 6. It will also be seen that the driven feed rolls 20a and 20b of the sorter infeed means 7 are driven together with the feed belt 20c. In addition, it will be seen that there is a drive chain or belt between the driven roller 9a of the rollers 9 in door 11 with a drive sprocket 9c located at the lower end of door 11 about the axis of which the door 11 is adapted to swing open and closed. Referring now to FIG. 6, it can be seen that the driven roller 15a which is driven by motor M2, through a belt 15d, drives the driven infeed roller 15b. At this side of the apparatus, the driven roller 15a drives a continuous chain or belt 15e which extends upwardly to drive infeed roller 3b, then downwardly to drive the shaft, 9d on which the drive sprocket 9c, previously referred to, is mounted, whereby the transport rolls 9 are driven. The drive belt 15e then extendds about an idler pulley 15f to drive a pulley 15g which, through a belt 15h drives the driven infeed roll 20b of the sorter infeed 7. Drive belt 15a then extends to a slack adjuster pulley 15i and back to the point of beginning of driven pulley 15a. Accordingly it is recognized that all driven pullies are effectively driven by the single motor M2.

Sheets will be transported from the input infeed rolls 3, when the apparatus is in the condition shown in FIG. 4 into engagement with the closed gate 8. This gate 8 is pivoted at 8a to swing between the broken line position and the full line position, shown in FIGS. 4 and 5, respectively, for bypassing sheets to the sorter infeed means 7 or directing sheets into the stacker infeed means 6. The gate 8 is adapted to be actuated between the two positions by a suitable solenoid or other actuator 8b (FIG. 4).

The sorting apparatus containing trays 5 is generally denoted at SA. It is generally like that shown in U.S. Pat. No. 4,580,775, but the sorter may have other constructions. In the invention, as shown, however, the sorter enables the overall height of the apparatus to be small because the trays 5 are normally close together, but are opened to provide a large sheet entry space E (FIG. 5) as sheets are being transported to the trays by the sorter infeed 7.

More, particularly, the sorter as generally illustrated is of the moving bin opener type shown in said Pat. No. 4,580,775, incorporated herein by reference for a more detailed understanding, if necessary. Such sorters have their trays 5 inclined upwardly from the sheet inlet ends 5a. At these ends the trays have trunnions 30 projecting outwardly from opposite sides for engagement with cams 31, here shown as spiral cams, mounted on vertically extended drive shafts 25, previously referred to at opposite sides of the assembly. The cams 31 are vertically shiftable on shafts 25 but rotate with the shafts. A drive motor M1 (FIG. 6) drives the shafts 25 in unison and in opposite directions by suitable sprocket, chain and gear means 33 under the control of an electrical control system to cause shafts 25 to rotate the cams 31 during the sheet sorting process.

The cams are rotated to cause sequential opening of the trays 5 at the enlarged sheet entry space E to receive one or more sheets under the control of suitable control means (not shown) as well known in the art relating to moving bin sorters.

Each rotation of the cam 31, will cause the cams profile to engage the trunnions of the trays to displace the inner end 5a of one tray the height of the cam depending on the direction of rotation. This height defines the height of entry space E. Such displacement of the cams and enlargement of the space E is illustrated in FIG. 5, wherein the sorter is in condition to receive a sheet supplied from the sorter infeed means 7. It will also be seen in FIG. 5 that the inner end of the infeed means 7 has been moved downwardly from the upper sorting position of FIG. 4, since the support cage 24 is connected to the cams to move vertically therewith as the cans rotate.

As the trays 5 are opened by the cams 31 at their sheet inlet ends 5a by the cams 31, the outer ends 5b of the trays pivot one on the other. The outer ends of all trays 5 are supported on a base support 5c suitably mounted in the frame or housing.

Referring to FIG. 6, it will be seen tha the door 11 can swing open on the horizontal axis of drive sprocket or pulley 9c for the feed rolls 9 in the door. This enables access to the interior of the housing for clearing any paper jams or other requirements. In this illustration, the lower plate 17 of the stacker infeed 6 is shown pivoted downwardly for access, and it is apparent that the lifter 23 on the upper plate 21 of the sorter infeed 7 is accessible.

In order to prevent closure of the door while the stacker infeed is open, means are provided to prevent such closure or indicating the open condition of the stacker infeed. A lever 40 is shown pivoted at 41 and having an arm 42 disposed for engagement by the outer end of infeed plate 17 when it swings downwardly to cause the other end or arm 43 of the lever 40 to swing from its broken line position to its full line position, indicating that infeed 6 is open. In addition, the outer end of arm 43 is positioned to pysically interfere with full closure of the door until the infeed is re-closed and the lever returned to the broken line position.

Having thus described an illustrative embodiment, what is claimed as the invention is defined in the appended claims.

1. Sorter/Stacker apparatus for use with a printer supplying sheets of paper comprising: a housing, sorter means in said housing including a plurality of vertically arranged horizontally extended trays for receiving sheets, stacker means spaced vertically in said housing from said sorter means and having a receiver tray means for receiving sheets, sheet transport means for transporting sheets from said printer in said housing to said sorter means and said stacker means, sorter sheet infeed means in said housing for carrying sheets to said sorter means for said transport means, stacker sheet infeed means in said housing for carrying sheets to said stacker means from said transport means, and means for selectively directing sheets transported by said transport means to said sorter infeed means or said stacker infeed means, an access door for said housing exposing said sorter sheet infeed means and said stacker sheet infeed means when said door is opened, said housing and said door having complemental portions of said sheet transport means carried thereby to complete the transport of sheets to said sorter sheet infeed means and said stacker sheet infeed means only when said door is closed.

2. Sorter/Stacker apparatus as defined in claim 1, wherein each of said sorter sheet infeed means and said stacker sheet infeed means includes opposing sheet transport members and means mounting said members for separation from sheet feeding relation when said door is opened.

3. Sorter/Stacker apparatus as defined in claim 2, including means for indicating that said members of one said sheet infeed means are opened.

4. Sorter/Stacker apparatus as defined in claim 2, including means for preventing said door from closing when said members of one of said sheet infeed means are separated.

5. Sorter/Stacker apparatus as defined in claim 1, wherein said sorter means includes means supporting said plurality of trays relative to said sorter sheet infeed means for movement between closely spaced positions and positions spaced apart to provide an enlarged sheet entry space at said, sorter sheet infeed means and means for moving said trays successively to provide said enlarged space.

6. Sorter/Stacker apparatus as defined in claim 5, wherein said means for moving said trays includes a cam and means for driving said cam in opposite directions.

7. Sorter/Stacker apparatus as defined in claim 5, wherein said means for moving said trays includes a cam and means for driving said cam in opposite directions, said cam being freely vertically movable relative to said driving means for vertical movement of said cam from tray to tray responsive to co-engagement of said cam and said trays as said cam successively provides said enlarged space.

8. Sorter/Stacker apparatus as defined in claim 1, including a drive motor and drive means driven by said motor to simultaneously drive said sheet transport means, said sorter sheet infeed means and stacker sheet infeed means.

9. Sorter/Stacker apparatus comprising a housing adapted to be associated with a printer supplying sheets of paper, sheet infeed means to carry sheets into said housing from the printer, a stacker tray, and a sheet sorter in said housing in vertically spaced relation, sheet transport means for moving sheets vertically in said housing, first and second deflector means for deflecting sheets selectively towards said stacker tray and said sorter from said transport means, a stacker sheet infeed extending between said transport means at the first of said deflecting means and said stacker tray, a sorter sheet infeed extending between said transport means at the second of said deflector means and said sorter, one of said deflector means being movable to an inoperative position permitting transport of sheets by said sheet transporting means to the other of said deflector means, said sorter having a plurality of vertically spaced sorter trays, said sorter trays and said sorter sheet infeed being relatively vertically movable for distribution of sheets from said sorter infeed into said trays, a door on said housing, said sheet transport means including driver and idler sheet engaging components in opposed relation, said idler sheet engaging components being carried by said door.

10. Sorter/Stacker apparatus as defined in claim 9, wherein each of said stacker infeed and said sorter infeed includes opposing sheet transport members and means mounting said members for separation when said door is open.

* * * * *